United States Patent [19]

Shibuya et al.

[11] 4,370,048

[45] Jan. 25, 1983

[54] ELECTROSTATIC COPYING APPARATUS

[75] Inventors: Kunihiro Shibuya, Yokohama; Koachi Uchida, Sagamihara; Shinichi Hashimoto, Fujisawa, all of Japan

[73] Assignee: Tokyo Shibaura Denki Kabushiki Kaisha, Kawasaki, Japan

[21] Appl. No.: 233,433

[22] Filed: Feb. 11, 1981

[30] Foreign Application Priority Data

Feb. 14, 1980 [JP] Japan ..... 55-17088

[51] Int. Cl.[3] ..... G03G 15/00

[52] U.S. Cl. ..... 355/3 TR; 271/311; 271/DIG. 2; 355/3 SH

[58] Field of Search ..... 355/3 TR, 3 TE, 3 R, 355/3 SH; 271/DIG. 2, 307–313

[56] References Cited

U.S. PATENT DOCUMENTS 3,936,045 2/1976 Ariyama ..... 271/DIG. 2
4,000,942 1/1977 Ito et al. ..... 271/DIG. 2
4,110,031 8/1978 Ebi et al. ..... 355/3 TR
4,159,172 6/1979 Tani et al. ..... 355/3 TR
4,163,549 8/1979 Ito et al. ..... 271/DIG. 2

*Primary Examiner*—R. L. Moses
*Attorney, Agent, or Firm*—Cushman, Darby & Cushman

[57] ABSTRACT

An electrostatic copying apparatus comprises a photosensitive drum, a transfer roller and a tape. The photosensitive drum includes first and second drum portions and a photosensitive layer which is laid on the outer periphery of the first drum portion and on which an image has been developed. The transfer roller in contact with the photosensitive layer, and cooperates with the photosensitive layer to clamp a sheet of paper to transfer the developed image onto the sheet of paper. The tape is in slidable contact with the outer periphery of the second drum portion for peeling the sheet of paper from the photosensitive drum after the image developed has been transferred to the sheet.

3 Claims, 5 Drawing Figures

ELECTROSTATIC COPYING APPARATUS

BACKGROUND OF THE INVENTION

This invention relates to an image transfer device for an electrostatic copying apparatus comprising a photosensitive drum, and more particularly to apparatus usable with an electrostatic copying apparatus for transferring an image developed on a photosensitive drum onto a sheet of paper being fed, while clamped between a roller and the photosensitive drum.

Used recently in increasing numbers are electrostatic copiers wherein a sheet of paper is clamped between a photosensitive drum and a roller which is applied with voltage so that an image developed on the drum is transferred onto the sheet as the sheet is fed forward. This is because this image transfer method does not generate ozone, and it does not require such a high voltage as is necessary when corona discharge is used to transfer an image from a photosensitive drum onto paper.

As soon as the image is transferred onto it, the sheet must be peeled from the photosensitive drum though it is attracted to the drum under an electrostatic force. The sheet must be quickly fed to a fixing device. To peel the sheet of paper from the drum quickly a tape has long been used. The tape extends in the paper-feeding direction, with both ends fixed, and put in frictional contact with the circumference of one end portion of the drum. The tape is interposed between the drum and one lateral portion of the sheet. The lateral portion of the sheet is not therefore attracted to the drum in spite of the electrostatic force. Thus, as soon as the forward end portion of the sheet comes out of the gap between the drum and the roller, its corner portion, i.e. the forward end part of the lateral portion, falls under its own weight. Then, the other portion of the sheet is gradually peeled from the drum as the sheet is fed.

Interposed between the drum and the roller and fixed at both ends, the tape is pulled in the paper-feeding direction as long as the photosensitive drum is rotating. The tape will eventually be broken and will have to be replaced by a new one. Further, a sheet of paper which is about to leave the drum is likely to tilt about the portion which is still sandwiched between the tape and the photosensitive drum. This results in transfer of a deformed image and may cause jamming of sheets of paper.

SUMMARY OF THE INVENTION

It is accordingly an object of this invention to provide an electrostatic copying apparatus wherein a tape and a roller are so positioned with respect to a photosensitive drum that a sheet of paper is readily peeled from the drum and an image developed on the drum is well transferred onto the sheet.

DETAILED DESCRIPTION OF THE PREFERRED EMBODIMENTS

Figure 1:
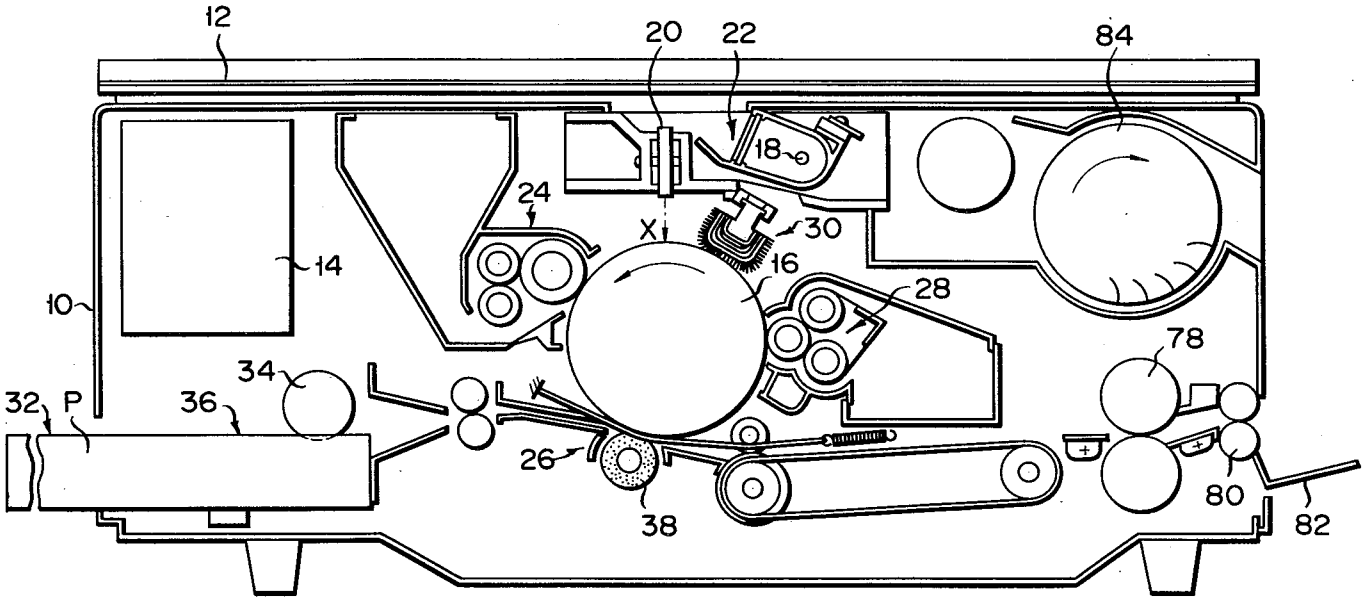
FIG. 1 schematically illustrates an electrostatic copying apparatus according to one embodiment of this invention.

An electrostatic copying apparatus embodying this invention will now be described with reference to FIGS. 1 to 4. As shown in FIG. 1, the apparatus comprises a housing 10 and a table 12 disposed on the upper surface of the housing 10. The table 12 receives an original of which a copy or copies are made. The table 12 moves back and forth when driven by a motor 14 provided within the housing 10. In the housing 10 there is provided a photosensitive drum 16 which is rotated counterclockwise as the table 12 moves to the left. The photosensitive drum 16 is constituted by first and second hollow portions **16*a* and 16*b* (as shown in FIGS. 4 and 5**) having the same outer diameter and coaxially aligned with each other and both made of metal. A photosensitive layer is laid on the entire outer periphery of the first and second cylinders. The layer is made of material which becomes electrically conductive when it receives light. For example, the layer is made of mixture of a zinc oxide, sensitizer and binder.

Between the table 12 and the photosensitive drum 16 an exposure system 22 is arranged. The system 22 comprises a lamp 18 and a focusing optical fibers array 20. The lamp 18 illuminates an original placed on the table 12 when the table moves back and forth. The light reflected from the original is focused by the fibers array 20 and is then applied onto the photosensitive drum 16 to form an electrostatic latent image on the photosensitive layer of the drum 16. Around the drum 16 there are arranged a developing device 24, a transfer device 26, a cleaning device 28 and a charging device 30, in this order in the direction of rotation of the drum 16.

The developing device 24 applies toner onto the photosensitive drum 16, thereby to develop the electrostatic latent image which has been formed on the photosensitive layer by the exposure system 22. The transfer device 26 transfers the image thus developed from the photosensitive drum 16 onto a sheet P of paper. The cleaning device 28 removes residual toner from the drum 16 after the image has been transferred to the sheet P.

A paper feeder 36 is provided within the housing 10. The paper feeder 36 comprises a paper cassette 32 and a roller 34. The cassette can be detached from the housing 10 and is to contain a stack of sheets P. The roller 34 is rotated to feed sheets P one by one to the transfer device 26.

Figure 2:
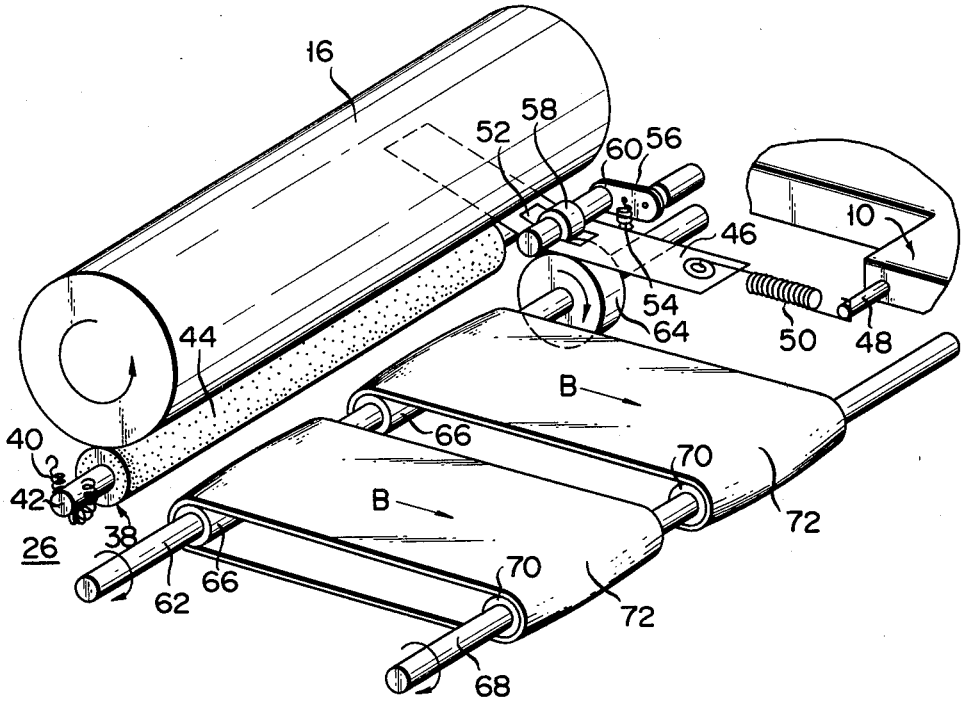
FIG. 2 is a perspective view of the important parts of the apparatus shown in FIG. 1.
Figure 3:
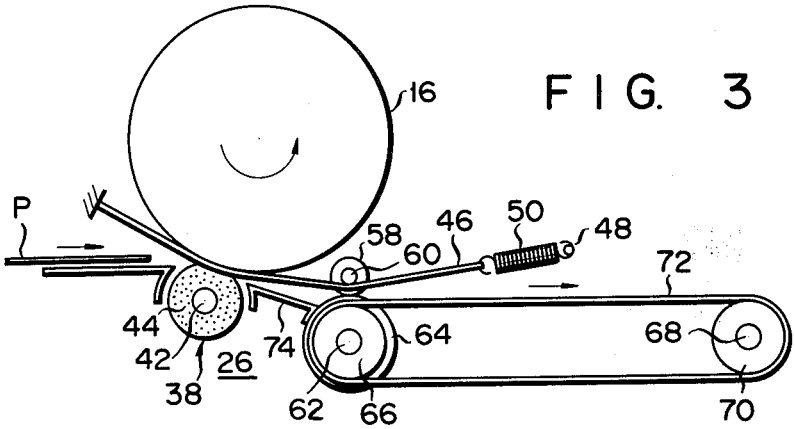
FIG. 3 is a side view of the parts shown in FIG. 2.
Figure 4:
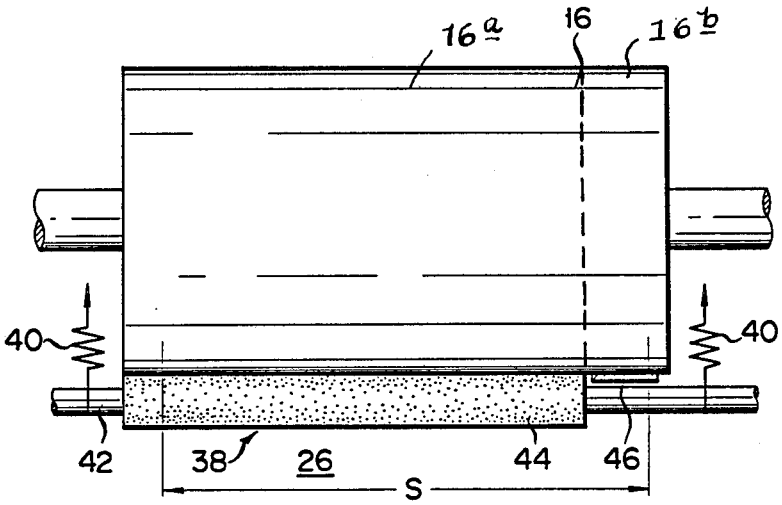
FIG. 4 is a front view of the parts shown in FIG. 2.
Figure 5:
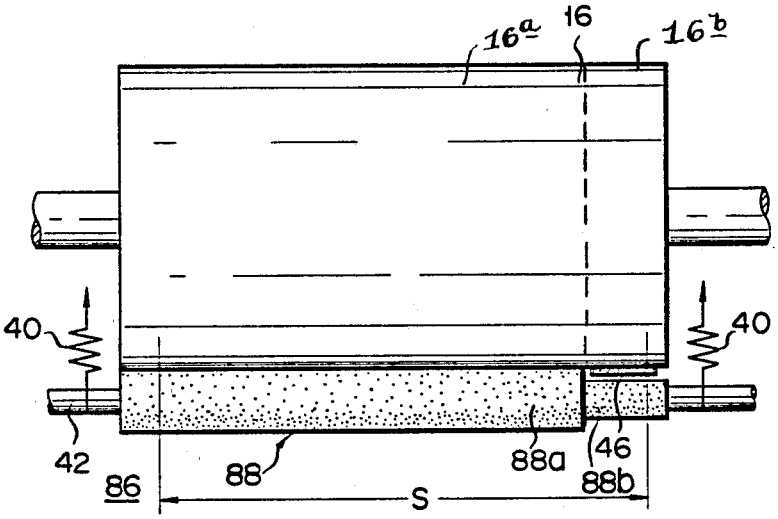
FIG. 5 is a front view of the important parts of an electrostatic copying apparatus according to another embodiment of this invention.

As shown in FIGS. 2 to 4, the transfer device 26 has a transfer roller 38. The transfer roller 38 consists of a shaft 42 and a hollow cylinder 44 of elastic material. The shaft 42 extends through the cylinder 44 and is suspended by a pair of coil springs which are attached respectively to the end portions of the shaft 42. Both the shaft 42 and the cylinder 44 are made of electrically conductive material. A predetermined voltage is applied on the shaft 42 and the cylinder 44 whenever necessary. The cylinder 44 is put in contact with the entire photosensitive drum 16, except for portion **16*b* thereof. That is, the cylinder 44 is a little shorter than the photosensitive drum 16 as shown in FIG. 4. A length of tape 46 extends across portion 16*b* of the photosensitive drum 16 in the direction in which sheets P are feeding. The tape 46** is made of Mylar (tradename).

It is put in slidable contact with the end portion 16*b* of the drum 16 which the cylinder 44 does not touch. A sheet P is clamped between the drum 16 and the cylinder 44, except for one lateral portion. The tape 46 is thus placed between the drum 16 and the lateral end portion of the sheet P.

The tape 46 is supported as illustrated in FIGS. 2 and 3. It has its one end connected to the housing on the paper input side of the drum 16 and its other end connected to a pin 48 by a coil spring 50 on the paper output side of the drum 16. The pin 48 is attached to the housing 10. The coil spring 50 pulls the tape 46 to the pin 48, thus stretching the tape 46 straight all the time. The tape 46 has a long rectangular slit 52 which extends in the paper feeding direction and which is located at a distance from the axis of the drum 16 toward the pin 48.

A lever 56 is fastened to the housing 10 by a pivotal connection. The lever 56 is urged downward by a coil spring 54. From the free end of the lever 56 a shaft 60 protrudes in a direction parallel to the axis of the drum 16. On the shaft 60 an auxiliary paper feeding roller 58 is rotatably mounted. The shaft 60 extends above that portion of the tape 46 where the slit 52 is cut. And the roller 58 is placed in the slit 52 so as to bring the shaft 60 into slidable contact with the tape 46. Thus, the tape 46 slidably contacts not only the drum 16 but the shaft 60.

Below the auxiliary paper feeding roller 58 a driven shaft 62 extends in a direction parallel to the axis of the photosensitive drum 16. On one end portion of the shaft 62 a paper feeding roller 64 is fixed so as to touch the auxiliary paper feeding roller 58. Further on the other portion of the shaft 62 a pair of crown rollers 66 are fixed. A driving shaft 68 extends parallel to the driven shaft 62 and spaced from the driven shaft 62. Also on the driven shaft 68 a pair of crown rollers 70 are fixed. An endless belt 72 is put on the crown roller 66 and the crown roller 70, and another endless belt 72 on the other crown roller 66 and other crown roller 70. The driving shaft 68 is coupled to a driving mechanism (not shown) and is rotated by the mechanism.

As the driving shaft 68 rotates clockwise, the endless belts 72 move in the direction of arrows B. At the same time the paper feeding roller 64 rotates also clockwise, thus rotating the auxiliary paper feeding roller 58 counterclockwise. As shown in FIG. 3, a paper guide plate 74 is provided between the cylinder 44 and the paper feeding roller 64 and another paper guide plate.

As illustrated in FIG. 1, a fixing device 78 and a pair of paper output rollers 80 are provided on the paper output side of the endless belts 72. The fixing device 78 fixes an image transferred on the sheet P by the transfer device 26 and then feeds the sheet P to the paper output rollers 80. The rollers 80 put the sheet into a tray 82. As shown also in FIG. 1, within the housing 10 there is provided a fan 84 which discharges hot air from the housing 10 thereby to avoid an excessive temperature rise in the housing 10.

It will now be described how the electrostatic copying apparatus of the above-mentioned structure operates. The paper feeder 36 supplies a sheet P of paper to the transfer device 26. The sheet P is clamped between the photosensitive drum 16 and the transfer roller 38, except for the lateral end portion. As the sheet P is fed, while clamped in this manner, a necessary voltage is applied on the transfer roller 36. A toner image developed on the drum 16 is therefore transferred onto the sheet P. As the drum 16 and the roller 36 rotate, the lateral end portion of the sheet P moves through the gap between the shaft 42 and the tape 46. Thus it does not come into frictional contact with the cylinder 44, unlike the remaining portion of the sheet P. As it comes out of the gap between the shaft 42 and the tape 46, the lateral end portion of the sheet P falls by its own weight and pulls down the remaining portion of the sheet P. Consequently, the whole sheet P is smoothly peeled from the photosensitive drum 16. Since the tape 46 does not touch the transfer roller 38 at all, transfer roller 38 never exerts a tension on the tape 46.

The sheet P thus smoothly peeled from the photosensitive drum 16 is guided by the guide plate 74 and put on the endless belts 72. As the endless belts 72 move in the direction of arrows B, the lateral end portion of the sheet P is clamped between the paper feeding roller 64 and the auxiliary paper feeding roller 58. Thereafter the forward end of the sheet P is caught between two rollers which constitute the fixing device 78.

Now referring to FIG. 5, another embodiment of this invention will be described. In FIG. 5 the same numerals are used to designate and members as are shown in FIGS. 1 to 4 and will not be described.

This embodiment differs from the embodiment of FIGS. 1 to 4 with regard to the structure of a transfer roller 86. The transfer roller 86 consists of a shaft 42 made of an electrically conductive material and a stepped hollow cylinder 88 made of an electrically conductive material. That is, the stepped cylinder 88 is constituted by a large diameter portion 88*a* and a small diameter portion 88*b*. The large diameter portion 88*a* is put in contact with a portion 16*a* of photosensitive drum 16, whereas the small diameter portion 88*b* is spaced from a tape 46 which is placed in slidable contact with portion 16*a* of the drum 16. In other words, the cylinder 88 is put in contact with the drum 16, except for the small diameter portion 88*b*.

With this particular structure, the transfer roller 86 helps achieve the same effects as accomplished by the transfer roller 38 of the one embodiment shown in FIGS. 1 to 4. In addition, the roller 86 serves to achieve the following effect.

That is, if the gap between the shaft 42 and the tape 46 is relatively large, the lateral end portion of a sheet P falls by its own weight to so low a position that it may be folded double as it is fed into the gap between a paper feeding roller 64 and an auxiliary paper feeding roller 58. In the embodiment of FIG. 5 the small diameter portion 88*b* of the cylinder 88 has such a diameter that it and the tape 46 define a gap which is narrow enough not to allow the lateral end portion of the sheet P to fall down too much by its own weight and thus to prevent the lateral end portion from being bent double.

In one embodiment of FIGS. 1 to 4 and another embodiment of FIG. 5, the photosensitive drum 16 includes portions 16*a* and 16*b* and a photosensitive layer laid on the whole outer periphery of the first and second portions. Instead, the outer periphery of the second portion 16*b*, i.e. that portion of the outer periphery which is put in slidable contact with the tape 46 may not be covered by the photosensitive layer.

What we claim is:

1. An apparatus for transferring a developed image to a sheet of paper comprising:

a photosensitive drum having first and second portions, said drum including a photosensitive layer which is laid on the outer periphery of at least the first drum portion;

a transfer roller including a surface portion formed of an elastic material and disposed in contact with the first and not the second drum portions, said transfer roller cooperating with the photosensitive layer to clamp the sheet of paper to transfer the developed image onto the sheet of paper; and a tape provided apart from said transfer roller and in slidable contact with the outer periphery of the second drum portion for peeling the sheet of paper from the photosensitive drum after the image developed has been transferred to the sheet.

2. Apparatus according to claim 1, wherein said photosensitive layer is laid on the outer periphery of the second drum portion.

3. Apparatus according to claim 2, wherein the transfer roller has substantially the same length as the photosensitive drum and includes a first roller portion disposed contiguous with the photosensitive layer laid on the outer periphery of the first drum section and a second roller section which is coaxially aligned with the first roller section and which has a diameter smaller than that of the first roller section.

* * * * *